US010787302B2

(12) United States Patent
Pupecki

(10) Patent No.: US 10,787,302 B2
(45) Date of Patent: Sep. 29, 2020

(54) OBJECT RETENTION AND STORAGE SYSTEM

(71) Applicant: Jason R. Pupecki, Worcester, MA (US)

(72) Inventor: Jason R. Pupecki, Worcester, MA (US)

( * ) Notice: Subject to any disclaimer, the term of this patent is extended or adjusted under 35 U.S.C. 154(b) by 376 days.

(21) Appl. No.: 15/829,936

(22) Filed: Dec. 3, 2017

(65) Prior Publication Data

US 2018/0201428 A1 Jul. 19, 2018

Related U.S. Application Data

(60) Provisional application No. 62/445,858, filed on Jan. 13, 2017.

(51) Int. Cl.

| | |
|---|---|
| ***B65D 81/28*** | (2006.01) |
| ***B65D 75/30*** | (2006.01) |
| *B65D 85/34* | (2006.01) |

(52) U.S. Cl.
CPC ..... *B65D 81/28* (2013.01); *B65D 75/305* (2013.01); *B65D 85/34* (2013.01)

(58) Field of Classification Search
CPC ..... B25B 11/00; A47J 47/005
See application file for complete search history.

(56) References Cited

U.S. PATENT DOCUMENTS

| | | | | |
|---|---|---|---|---|
| 4,987,725 | A * | 1/1991 | Gill | B65D 81/245 53/453 |
| 5,311,813 | A * | 5/1994 | Fairbanks | A47J 47/005 135/126 |
| 5,667,827 | A * | 9/1997 | Breen | B65B 25/067 426/108 |
| 7,165,376 | B2 * | 1/2007 | Kawashima | B65B 31/00 206/213.1 |
| 2009/0031747 | A1 * | 2/2009 | Lazzarini | A61L 9/12 62/288 |
| 2017/0027366 | A1 * | 2/2017 | Wilson | A47J 36/027 |
| 2017/0354292 | A1 * | 12/2017 | Caswell | A47J 36/027 |
| 2018/0201428 | A1 * | 7/2018 | Pupecki | B65D 75/305 |

* cited by examiner

*Primary Examiner* — Lee D Wilson
(74) *Attorney, Agent, or Firm* — Brian M. Dingman; Dingman IP Law, PC

(57) ABSTRACT

A system for retaining and storing an object, such as cut produce. By creating an air tight seal and preventing oxidizing air from reaching the insides of the fruit or vegetable, the system prolongs the lifespan of the produce, keeping it fresher, longer.

18 Claims, 10 Drawing Sheets

OBJECT RETENTION AND STORAGE SYSTEM

CROSS-REFERENCE TO RELATED APPLICATION

This application claims priority of Provisional Application 62/445,858 filed Jan. 13, 2017.

BACKGROUND

This application relates to a device that releasably retains objects such as fruits and vegetables.

Fruits and vegetables have a skin or peel on their exterior. This natural barrier protects the vulnerable insides from harmful air and gases that can cause the food to spoil. Once this barrier is compromised, the perishable insides begin to rapidly degrade, drastically shortening lifespan.

Existing methods and containers that store half-used produce, such as plastic storage containers and plastic storage bags, trap in oxidizing air, as well as ethylene gas produced by the aging produce. They thus do little to reduce spoilage of cut fruits and vegetables.

Objects other than fruits and vegetables also need to be removably stored.

SUMMARY

The present system creates an air-tight seal against the exposed interior of cut fruits and vegetables. The system thus inhibits or prevents oxidizing air from reaching the insides of the fruit or vegetable, thus prolonging the lifespan of the produce, keeping it fresher longer.

The present object storage and retention system stores half-used fruits and vegetables firmly in place via a flexible material that seals out air and other gases.

The system differs from what currently exists. This retention storage system doesn't simply put the produce in a container like current methods.

This system is an improvement on what currently exists. This retention storage system creates an air tight seal between the cut end of produce and a flat surface.

The air and ethylene gas that current storage methods trap in with the produce quickens the spoiling process.

By creating an air tight seal and inhibiting or preventing oxidizing air from reaching the insides of the fruit or vegetable, this system and method prolongs the lifespan of the produce, keeping it fresher, longer.

The present system typically includes a (plastic) rigid frame of sufficient circumference to encircle most fruits and vegetables. A flexible web that can stretch over various sizes of fruits and vegetables is coupled to the frame. The outside perimeter of the web is attached to the inside perimeter of the frame. There is also a base or lid that matches the size of the frame. The frame can be snapped into, or otherwise removably coupled to, the base.

The system can work as follows: the base or lid is placed on a table with the features that allow it to be attached to the frame facing up. The cut fruit/vegetable is placed on the flat surface of the base or lid, with the cut side face down. The combined frame and web is placed over the fruit/vegetable and pressed down on the base/lid, until the two couple together. The flexible web will stretch over the fruit/vegetable, pressing it firmly against the flat surface of the base or lid, to create an air-tight seal against the cut side of the fruit/vegetable.

The web can be attached to the frame to become a single part (e.g., by injection or compression molding). This combined part is then stretched over an object and snapped into the base/lid to hold the object in place. Alternatively, the frame and base/lid could be attached to one another via a hinge, and then the unit could be opened and closed like a book.

The system has been described used to secure and seal cut fruits and vegetables. However, the system could be used to secure just about anything.

This disclosure features a system with a base that has a flat surface, and a cover comprising a frame and a flexible web coupled to the frame. The frame and base are constructed and arranged such that the frame can be removably coupled to the base, with the web overlying the flat surface of the base, such that an object placed on the flat surface can be retained, with the web stretched over the object. The object may comprise a cut fruit or vegetable, or any other object that is sized such that it can be held down by the web. The base may comprise a cutting board.

The web may comprise silicone rubber. The web may be coupled to the frame by injection or compression molding. The web may comprise a plurality of spaced arms. The arms may be generally radial. The arms may be generally "s"-shaped, so they can elongate further when stretched.

The base may comprise a first peripheral engaging portion with a first shape, and the frame may comprise a second peripheral engaging portion with a second shape, where the first and second shapes are complementary. The first and second shapes may be but need not be troughs with a terminal lip.

The base may have two opposed flat surfaces. The base may comprise a peripheral groove located between the two faces, and the frame may have a bead that is arranged to sit in the groove. The frame may be adapted to be engaged with the base in two locations. In the first of the two locations the frame may be in contact with one flat surface of the base, and in a second of the two locations the frame may be in contact with the other flat surface of the base.

DETAILED DESCRIPTION

Figure 1:
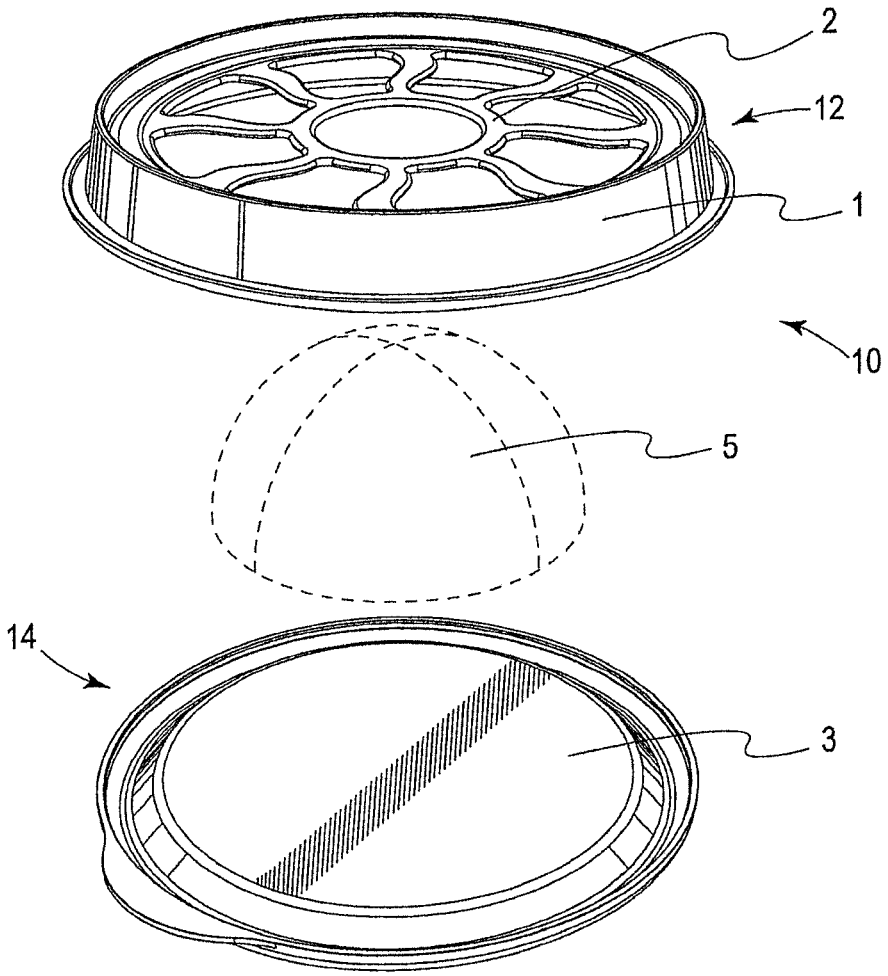
FIG. 1 is an exploded view of a first example of the present object retention and storage system.
Figure 2:
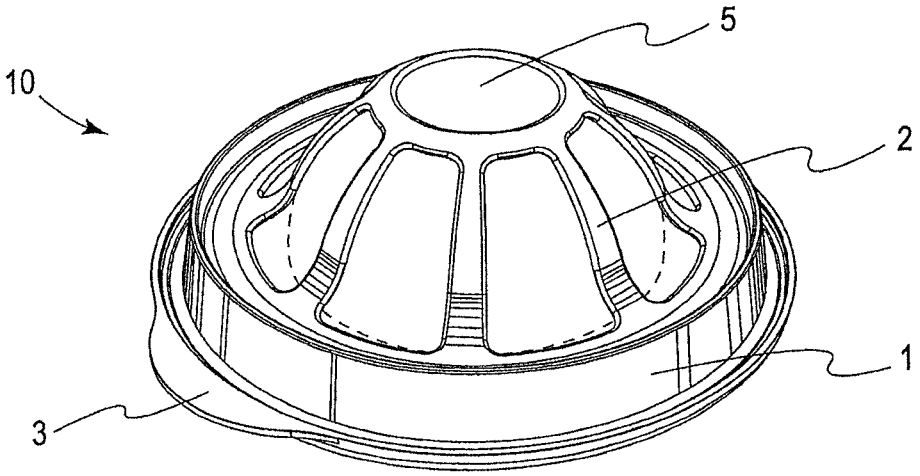
FIG. 2 is a perspective, assembled view of the object retention and storage system of FIG. 1.
Figure 3A:
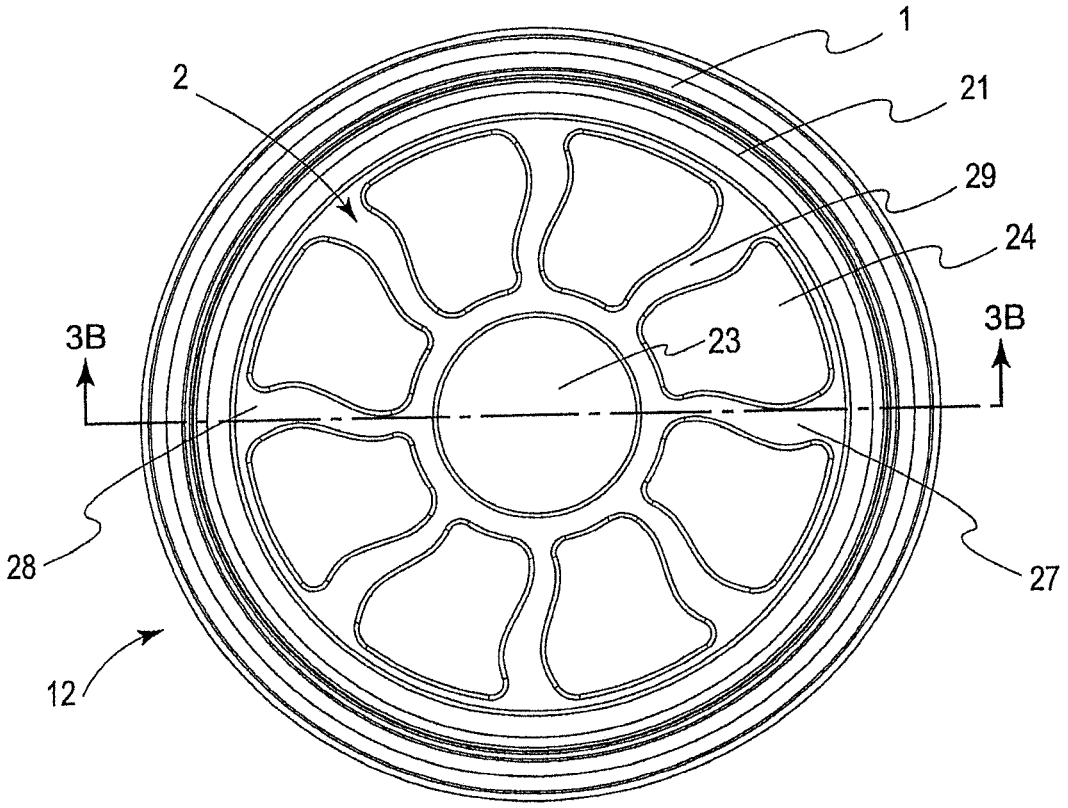
FIG. 3A is a top view of the cover of the object retention and storage system of FIG. 1.
Figure 3B:
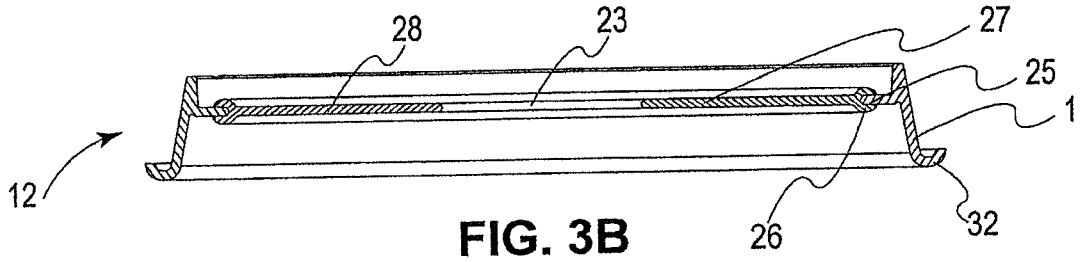
FIG. 3B is a cross-section taken along line 3B-3B, FIG. 3A.
Figure 4:
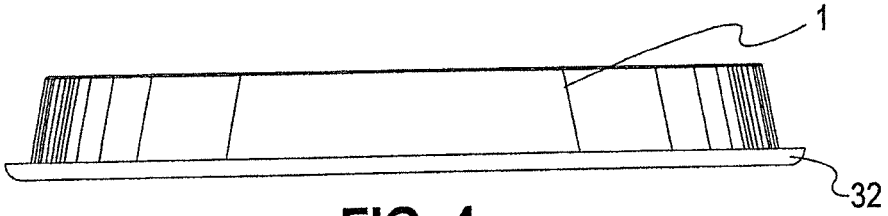
FIG. 4 is a side view of the cover of FIGS. 3A and 3B.
Figure 5:
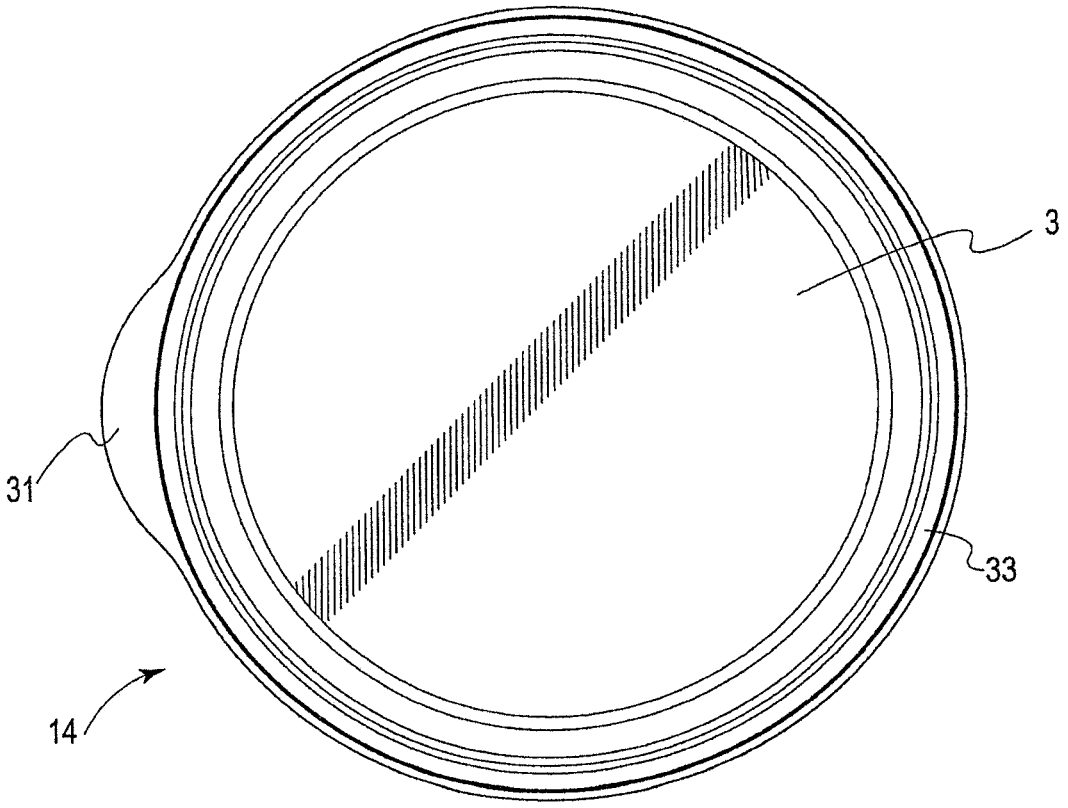
FIG. 5 is a top view of the base of the object retention and storage system of FIG. 1.
Figure 6:
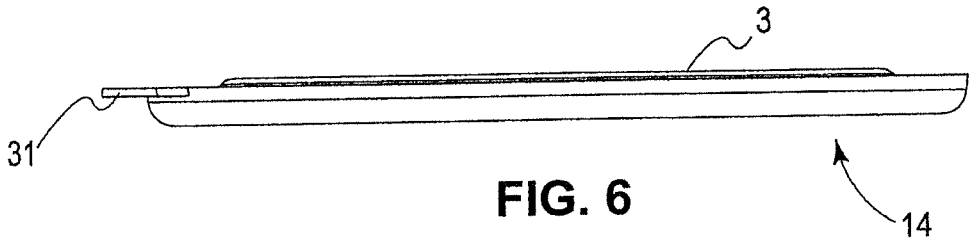
FIG. 6 is a side view of the base of FIG. 5.

A first example of system 10 is depicted in FIGS. 1-10. System 10 includes base or lid 14 with flat upper work surface 3. Base 14 can be made of any desired material, such as, without limitation, wood, metal, silicone, or plastic, e.g. System 10 also includes cover 12 that comprises frame 1 and stretch web 2 that spans the frame opening. Web 2 can have a desired design; two designs are depicted in the figures, but other designs are possible. The base and the frame are constructed and arranged such that the two can be removably coupled together, with the web overlying the flat surface 3. An object placed on the flat surface can be held in place against the surface by the web. If the object is a cut fruit or vegetable, with the cut side against the flat surface, the cut surface is not exposed to the air; this increases the useful life of the produce.

Non-limiting details of the web, and the temporary coupling of the base and frame, are shown for a first example of system 10, in FIGS. 1-10. Frame 1 of cover 12 can be a relatively rigid member made from plastic such as, without limitation, acrylonitrile butadiene styrene (ABS) or polypropylene, e.g. Frame 1 can be made of a non-plastic material with sufficient rigidity, such as a metal, for example. Web 2 is stretchy and can be made of, without limitation, a silicone rubber or other stretchy material. The two can be coupled together in any manner, as would be apparent to one skilled in the art. The present preferred manner is by injection or compression molding, where bead 26 of web 2 (FIG. 3B) is coupled to tang 25 of frame 1. Web 2 has several arms that in this example are generally "s"-shaped for greater stretching length, separated by openings. Arms 27 and 29 and intermediate opening 24 are numbered, as examples. Central opening 23 is also included, and can accommodate the end of a piece of fruit, for example. The web could take other forms, and need not have arms. For example, the web could be a continuous sheet of material. Also, if the web has arms, the arms do not need to be "s" shaped.

Figure 7A:
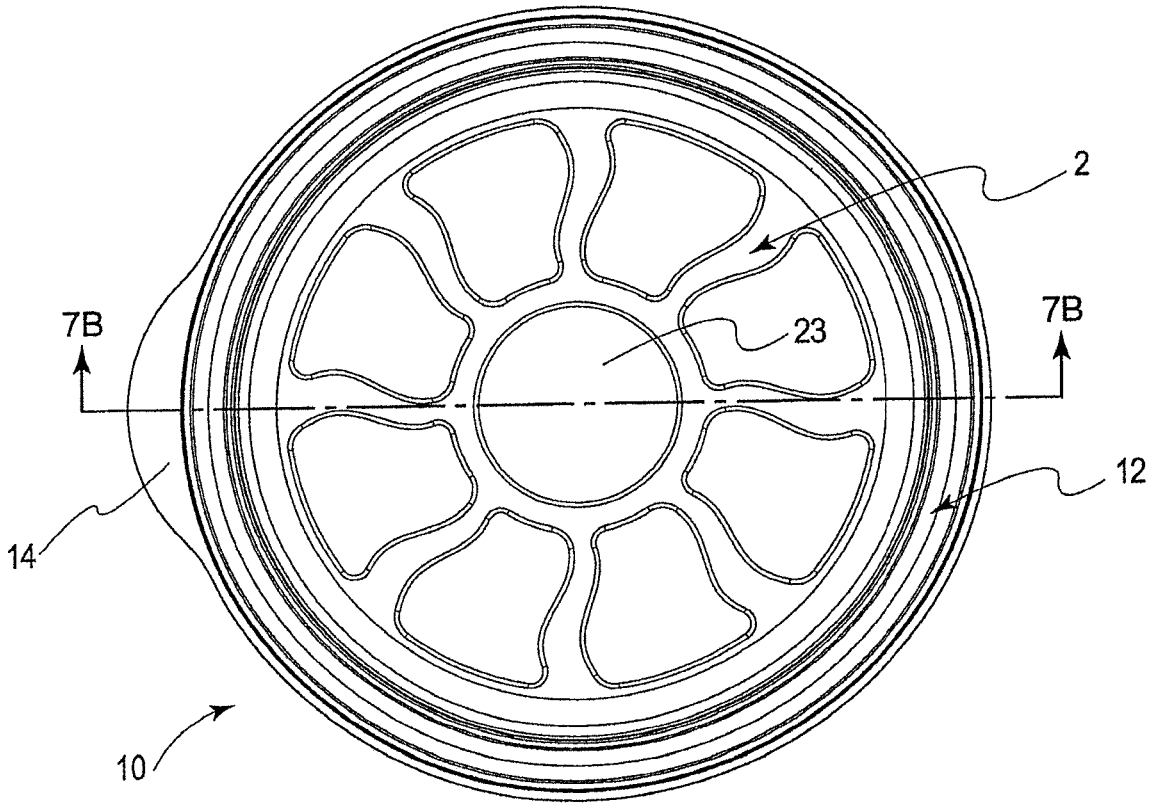
FIG. 7A is a top view of the object retention and storage system of FIG. 1.
Figure 7B:
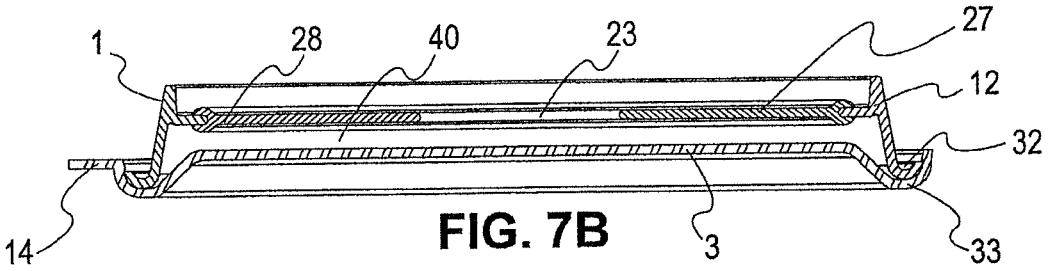
FIG. 7B is a cross-section taken along line 7B-7B, FIG. 7A.
Figure 8:
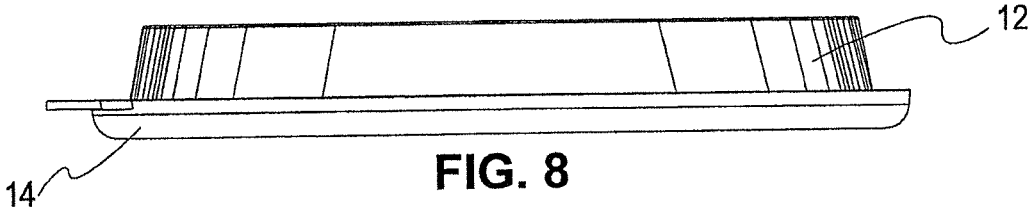
FIG. 8 is a side view of the system of FIGS. 7A and 7B.

Cover 12 is temporarily coupled to base 14 by bottom engaging portion 32 of frame 1 snapping into bottom engaging portion 33 of base 14; see FIG. 7B. Portions 32 and 33 can each be generally trough-shaped, with a peripheral upstanding lip, as shown. Portions 32 and 33 could have other complementary shapes, though. This creates space 40 between them, in which the object is located. Other constructions that removably couple the base and cover are contemplated and included herein, as would be apparent to one skilled in the art.

Figure 9A:
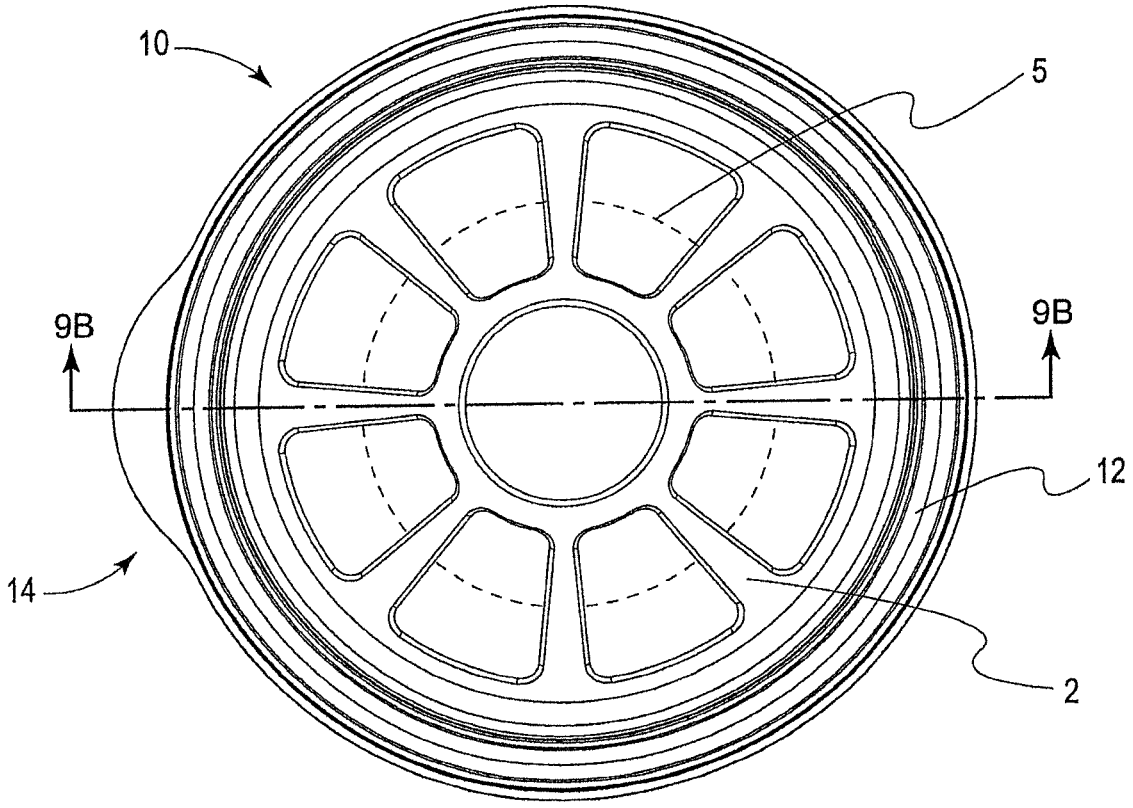
FIG. 9A is a top view of the object retention and storage system of FIG. 1 in use, storing an object.
Figure 9B:
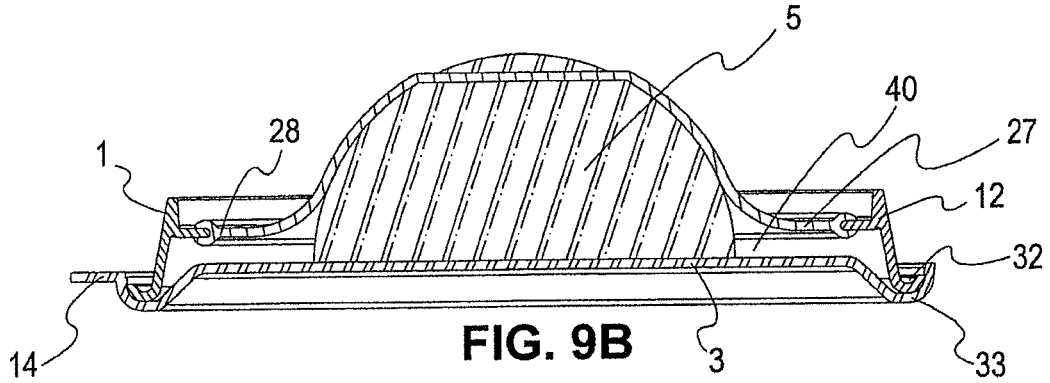
FIG. 9B is a cross-sectional view taken along line 9B-9B of FIG. 9A.
Figure 10:
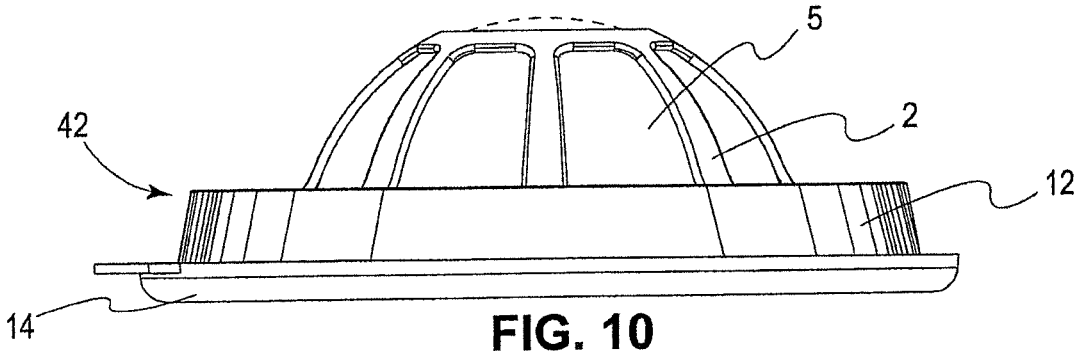
FIG. 10 is a side view of the object retention and storage system of FIGS. 9A and 9B.
Figure 11:
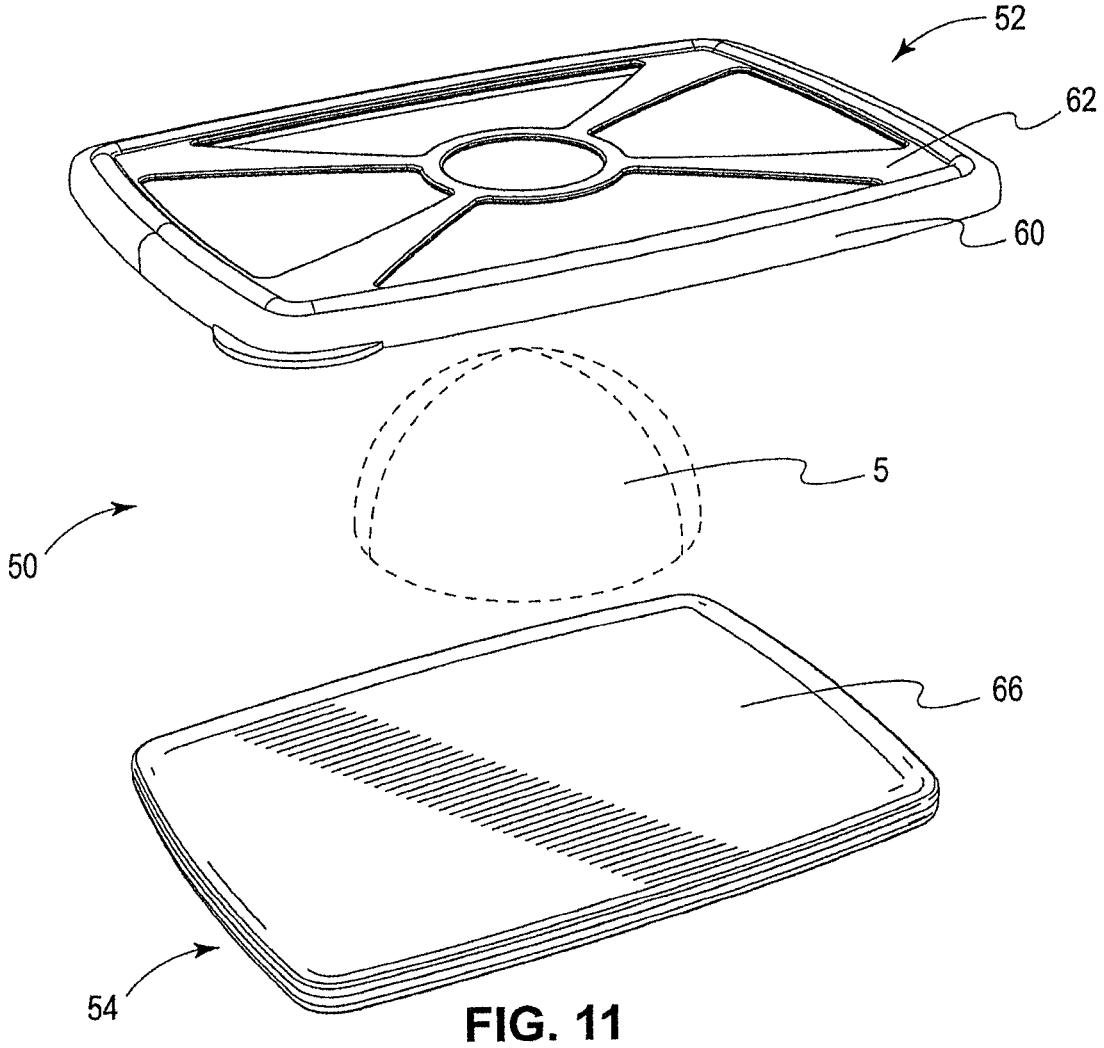
FIG. 11 is an exploded view of a second example of the present object retention and storage system.
Figure 12:
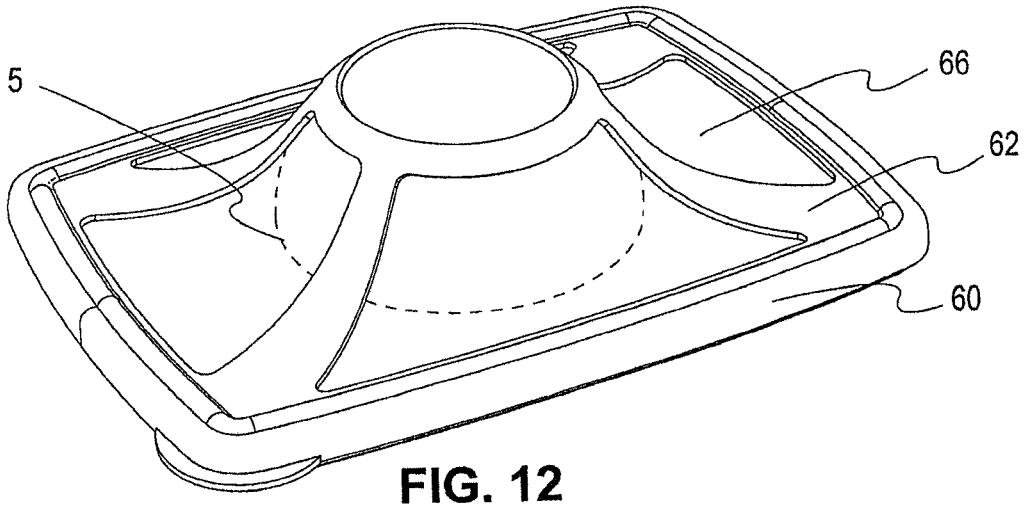
FIG. 12 is a perspective, assembled view of the object retention and storage system of FIG. 11.
Figure 13A:
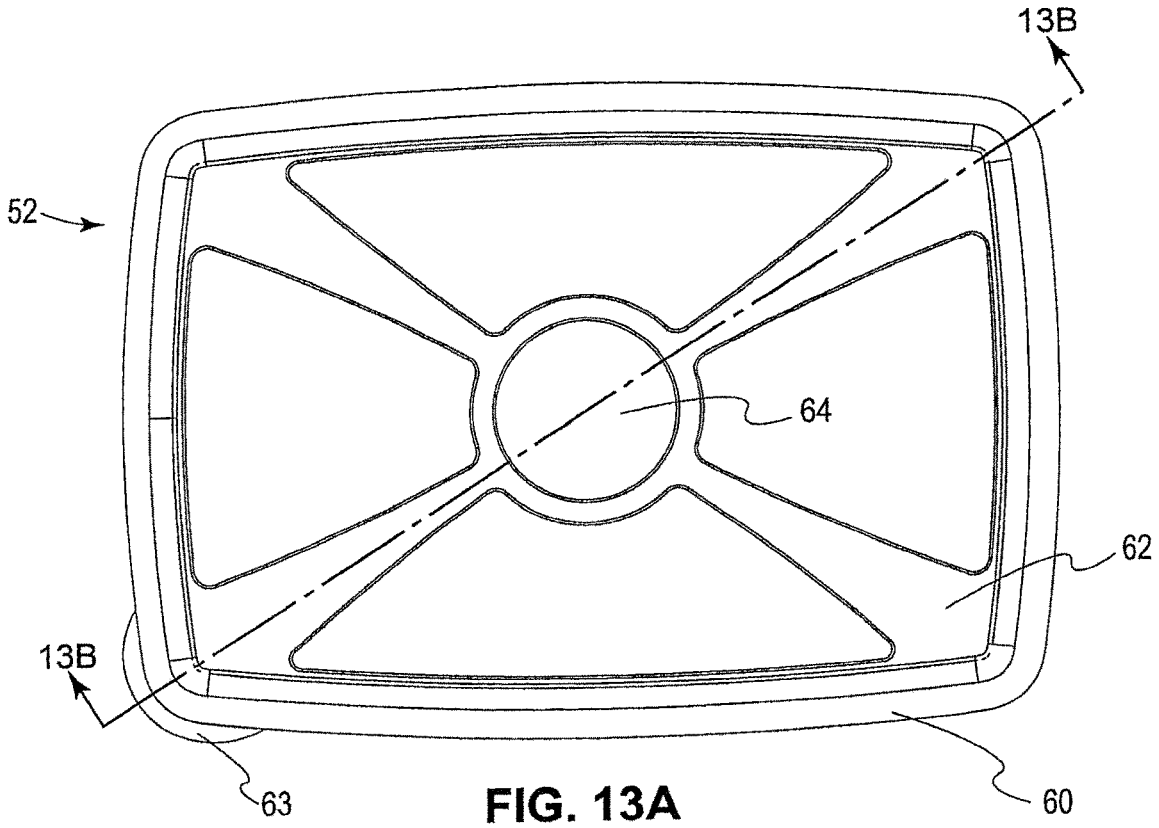
FIG. 13A is a top view of the cover of the object retention and storage system of FIG. 11.
Figure 13B:
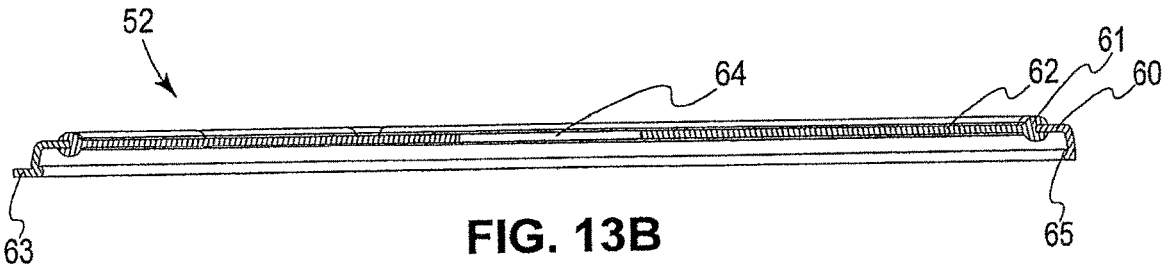
FIG. 13B is a cross-section taken along line 13B-13B, FIG. 13A.
Figure 14:
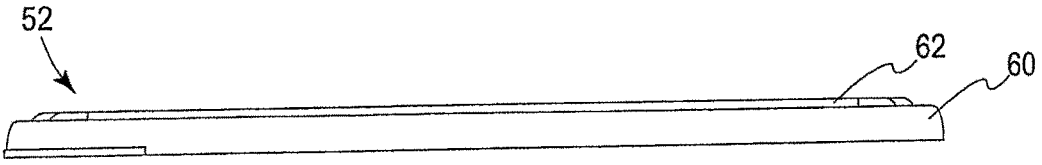
FIG. 14 is a side view of the cover of FIGS. 13A and 13B.
Figure 15:
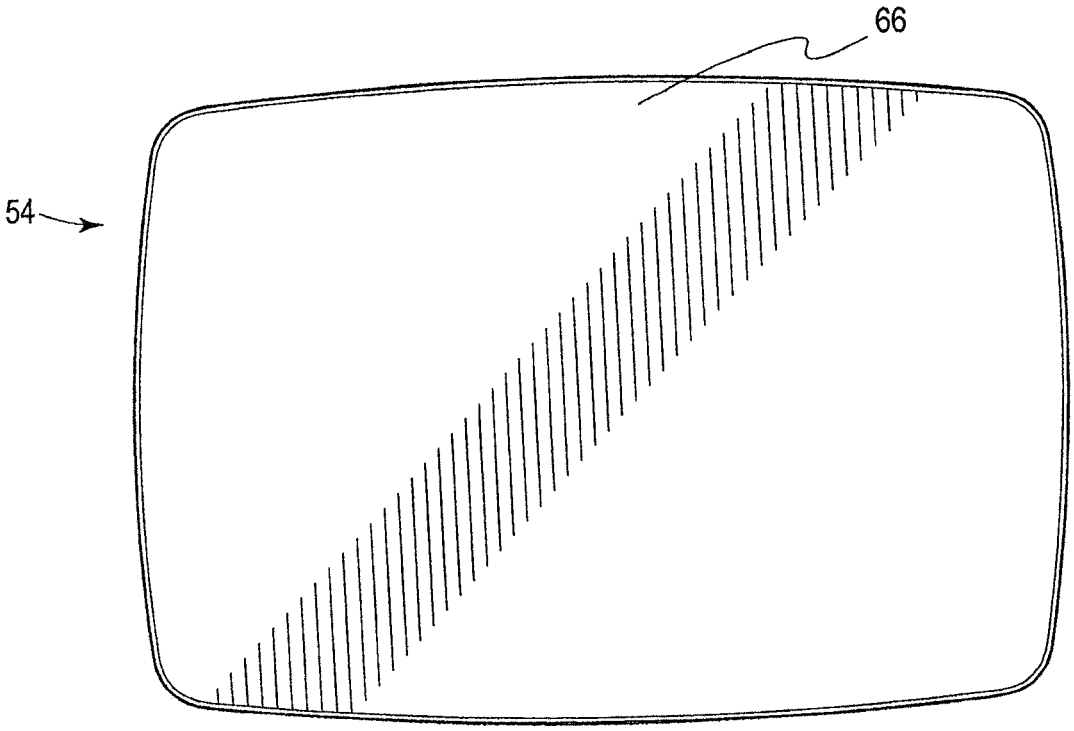
FIG. 15 is a top view of the base of the object retention and storage system of FIG. 11.
Figure 16:
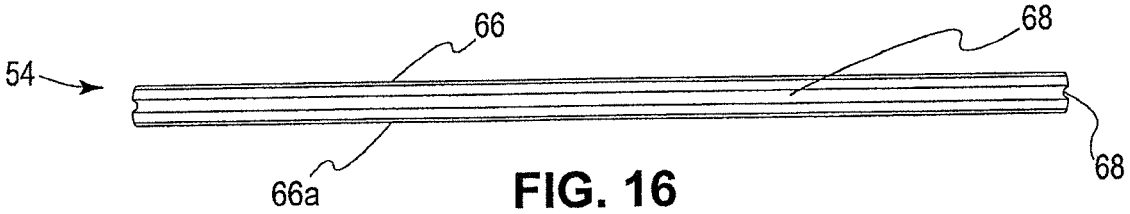
FIG. 16 is a side view of the base of FIG. 15.
Figure 17A:
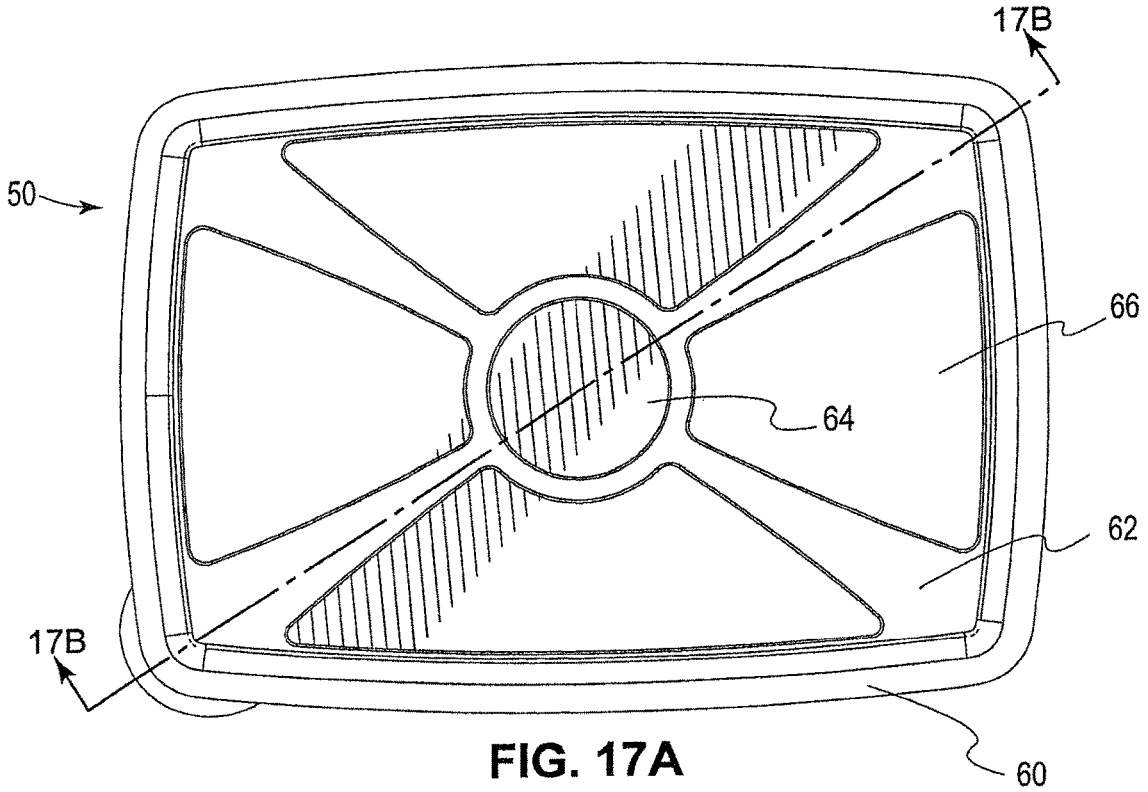
FIG. 17A is a top view of the object retention and storage system of FIG. 11.
Figure 17B:
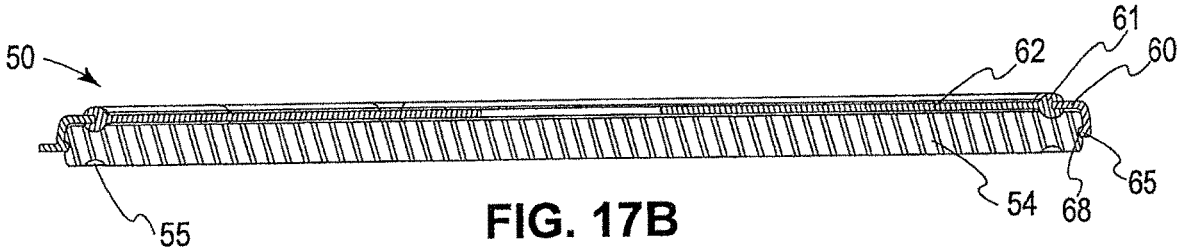
FIG. 17B is a cross-section taken along line 17B-17B, FIG. 17A.
Figure 18:
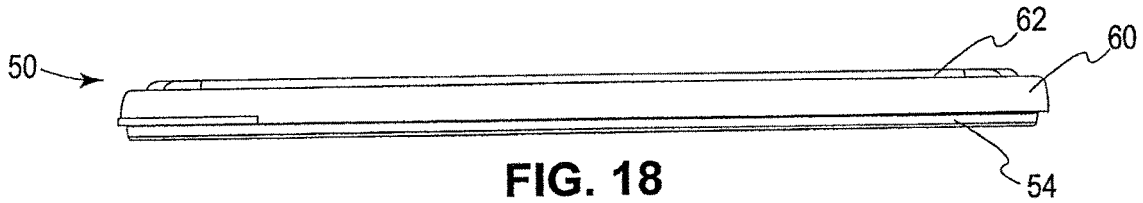
FIG. 18 is a side view of the base of FIGS. 17A and 17B.
Figure 19A:
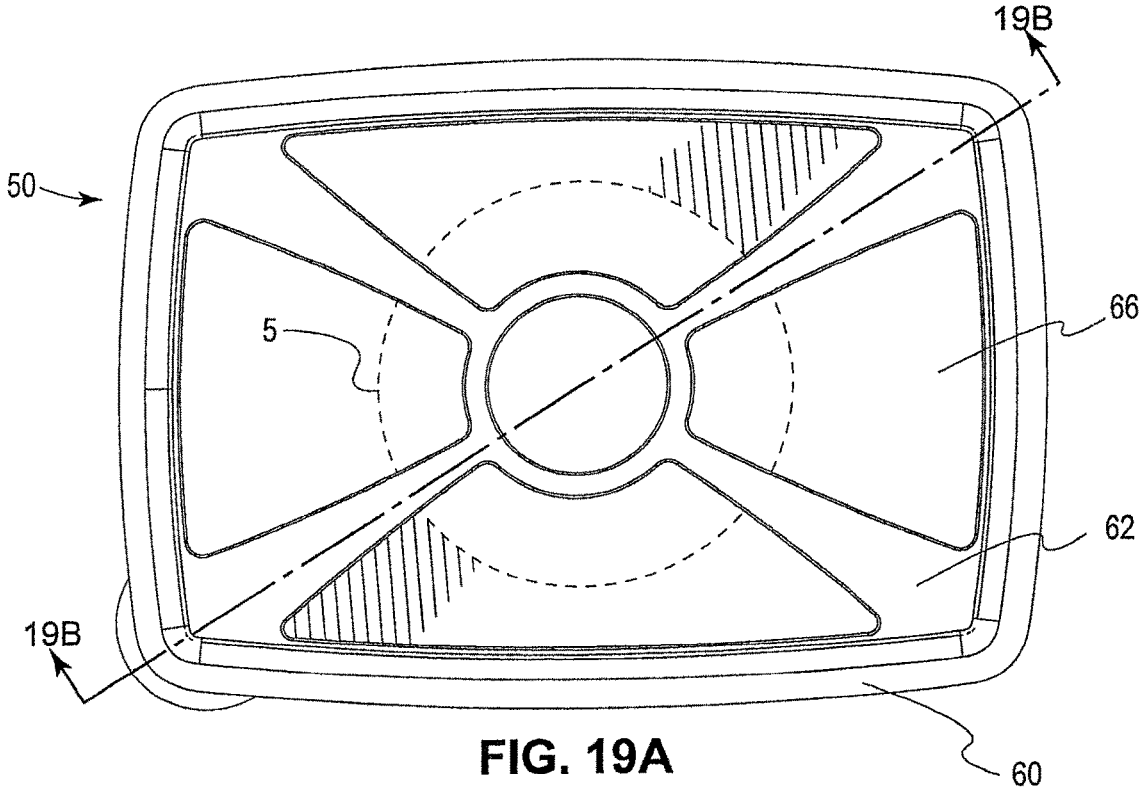
FIG. 19A is a top view of the object retention and storage system of FIG. 11 in use, retaining an object.
Figure 19B:
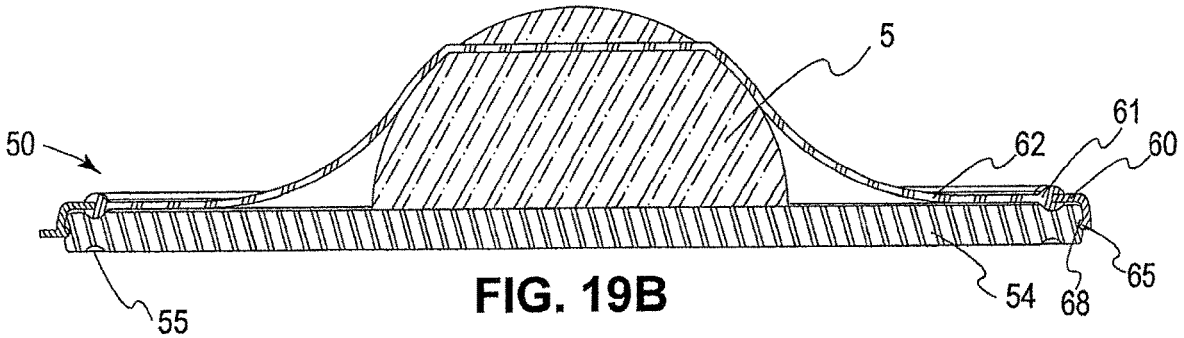
FIG. 19B is a cross-section taken along line 19B-19B of FIG. 19A.
Figure 20:
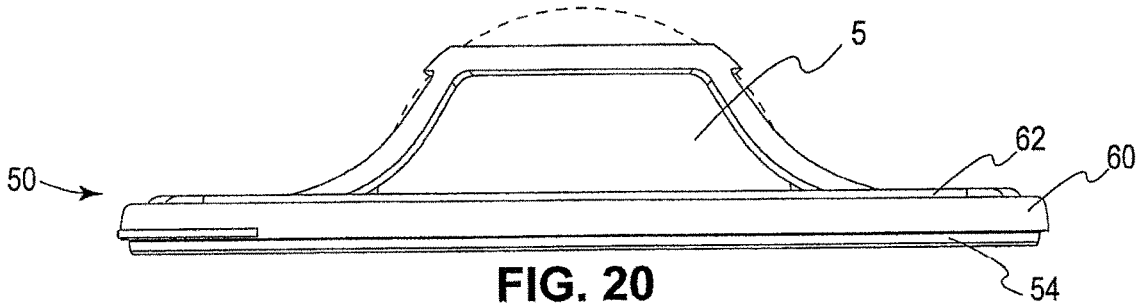
FIG. 20 is a side view of the object retention and storage system of FIG. 19A.

FIGS. 9 and 10 show system 10 in use, retaining object 5, which may be a half of an orange or another piece of fruit or vegetable, for example. As can be seen, the arms can straighten as they are stretched out, to provide more room for larger objects.

FIGS. 11-20 depict another example system 50. One difference over system 10 is that in this case the base 54 also serves as a cutting board. Preferably the base is made of, without limitation, a material that can be used as a cutting board, such as wood, bamboo, or plastic, e.g. The base can have two opposed flat faces or sides 66 and 66*a*, such that either side can be used as a cutting board, and the flat side on which the cut side of produce is placed. Cover 52 includes frame 60 and stretch web 62, in this case with four arms, although it could have fewer or more than four arms. Also, the web does not need arms; for example, it could be a continuous sheet. At least one opening (such as opening 64) is useful in order to be able to see the produce, but openings are not necessary.

Web 62 includes bead 61 where it is coupled to frame 60. This bead can sit in seat 55, to hold cover 52 on base 54. This allows cover 52 to sit against either face of the base, so that the cover can also serve as a non-skid base for base member 54, when the base member is used as a cutting board. Cover 52 can then be removed and inverted over surface 66 or 66*a*, and engaged/snapped in place via engaging bead 65 sitting in seat 68 along the perimeter of base 54. See FIG. 17B, which shows the cover sitting against upper face 66, before an object is placed between the cover and the base.

A number of implementations have been described. Nevertheless, it will be understood that additional modifications may be made without departing from the scope of the inventive concepts described herein, and, accordingly, other embodiments are within the scope of the following claims.

For example, the system can be used to removably hold all kinds of objects, in all kinds of situations. The frame and flexible web can be used to hold a spare helmet on the back of a motorcycle, or a basketball on the wall of a garage, as two of almost unlimited possibilities of using the frame and flexible web to hold an object in place but also allow the object to be removed as desired. In these examples, a base may not be needed, as the base could be an existing structure surface (e.g., a wall, or a surface of a motorcycle) to which the frame is coupled such that the frame can be moved from an object-engaging position to an object-free position. The frame can be made removable from the existing structure surface, as described above, or it can be fixed to the structure by a pivot (e.g., a hinge) and a releasable hold-down, latch, or other releasable engagement, so that the frame and web can be lifted off the structure and placed over the object, as desired.

What is claimed is:

1. A system, comprising:

a base with a flat surface; and a cover comprising a peripheral frame that defines a central opening, and a stretchy web coupled to the frame and spanning the central opening of the frame;

wherein the frame and base are constructed and arranged such that the frame can be coupled to the base with the web overlying the flat surface of the base, such that an object placed on the flat surface can be retained, with the web stretched over the object.

2. The system of claim 1, wherein the web is a continuous sheet of material.

3. The system of claim 2, wherein the web comprises a silicone-based material.

4. The system of claim 1, wherein the base comprises a cutting board.

5. The system of claim 1, wherein the web comprises silicone rubber.

6. The system of claim 1, wherein the web is permanently coupled to the frame.

7. The system of claim 1, wherein the web comprises a plurality of spaced arms.

8. The system of claim 7, wherein the arms are generally radial.

9. The system of claim 8, wherein the arms are generally "s"-shaped, so they can elongate further when stretched.

10. The system of claim 1, wherein the base comprises a first peripheral engaging portion with a first shape, and the frame comprises a second peripheral engaging portion with a second shape, where the first and second shapes are complementary.

11. The system of claim 10, wherein the first and second shapes are troughs with a terminal lip.

12. The system of claim 1, wherein the base has two opposed flat surfaces.

13. The system of claim 12, wherein the base comprises a peripheral groove located between the two faces, and the frame has a bead that is arranged to sit in the groove.

14. The system of claim 12, wherein the frame is adapted to be engaged with the base in two locations.

15. The system of claim 14, wherein in a first of the two locations the frame is in contact with one flat surface of the base, and in a second of the two locations the frame is in contact with the other flat surface of the base.

16. A system, comprising:

a base with an upper surface; and a cover comprising a peripheral frame that defines a central opening, wherein the frame has an inner perimeter, and a stretchy silicone-based web coupled to the frame and spanning the central opening of the frame, wherein the web has an outside perimeter that is coupled to the inside perimeter of the frame;

wherein the frame and base are constructed and arranged such that the frame can be coupled to the base with the web overlying the upper surface of the base, such that a fruit or vegetable placed on the upper surface can be retained, with the web stretched over the fruit or vegetable.

17. A system, comprising:

a cutting-board base with two opposed flat surfaces; and a cover comprising a peripheral frame that defines a central opening, and a stretchy web coupled to the frame and spanning the central opening of the frame;

wherein the frame and base are constructed and arranged such that the frame can be coupled to the base with the web overlying either of the flat surfaces of the base, where a fruit or vegetable placed on a flat surface can be retained, with the web stretched over the fruit or vegetable;

wherein the base comprises a peripheral groove located between the two faces, and the frame has a bead that is arranged to sit in the groove;

wherein the frame is adapted to be engaged with the base in two locations, wherein in a first of the two locations the frame is in contact with one flat surface of the base, and in a second of the two locations the frame is in contact with the other flat surface of the base.

18. The system of claim 1, wherein the frame is coupled to the base via a hinge.

* * * * *